US009890597B2

(12) United States Patent
Schwefe et al.

(10) Patent No.: US 9,890,597 B2
(45) **Date of Patent: *Feb. 13, 2018**

(54) DRILL BITS AND TOOLS FOR SUBTERRANEAN DRILLING INCLUDING RUBBING ZONES AND RELATED METHODS

(71) Applicant: Baker Hughes Incorporated, Houston, TX (US)

(72) Inventors: Thorsten Schwefe, Virginia Water (GB); Cara D. Weinheimer, Fort Worth, TX (US)

(73) Assignee: Baker Hughes Incorporated, Houston, TX (US)

( * ) Notice: Subject to any disclaimer, the term of this patent is extended or adjusted under 35 U.S.C. 154(b) by 17 days.

This patent is subject to a terminal disclaimer.

(21) Appl. No.: 15/095,538

(22) Filed: Apr. 11, 2016

(65) Prior Publication Data

US 2017/0022763 A1 Jan. 26, 2017

Related U.S. Application Data

(63) Continuation of application No. 12/898,451, filed on Oct. 5, 2010, now Pat. No. 9,309,723.

(Continued)

(51) Int. Cl.

*E21B 10/43* (2006.01)
*E21B 10/42* (2006.01)

(Continued)

(52) U.S. Cl.

CPC ..... *E21B 10/62* (2013.01); *E21B 7/04* (2013.01); *E21B 10/42* (2013.01); *E21B 10/43* (2013.01); *E21B 10/54* (2013.01)

(58) Field of Classification Search

CPC ..... E21B 10/08; E21B 10/16; E21B 10/42; E21B 10/43

See application file for complete search history.

(56) References Cited

U.S. PATENT DOCUMENTS 1,805,678 A 5/1931 Smith
1,923,487 A 8/1933 Howard et al.

(Continued)

FOREIGN PATENT DOCUMENTS

EP 169683 A2 9/1989
EP 532869 B1 9/1997

(Continued)

OTHER PUBLICATIONS

Baker Hughes' Use of a Drill Bit Embodying the Alleged Inventions of the Asserted Claims of the 930 Patent Prior to Aug. 26, 1998 Expert Report of Mark Thompson Jan. 18, 2008 Filed in Civil Action No. 6:06-CV-222 (LED) in the United Stated District Court for the Eastern District of Texas Tyler Division 5 pages (nonmaterial portions redacted).

(Continued)

*Primary Examiner* — Catherine Loikith
(74) *Attorney, Agent, or Firm* — TraskBritt

(57) ABSTRACT

A drill bit may include a bit body including at least one blade extending at least partially over a cone region of the bit body. Additionally, the drill bit may include a plurality of cutting structures mounted to the at least one blade and a rubbing zone within the cone region of the at least one blade, wherein cutting structures within the rubbing zone have a reduced average exposure. Additionally, a method of directional drilling may include positioning a depth-of-cut controlling feature of a drill bit away from a formation to prevent substantial contact between the depth-of-cut controlling feature and rotating the drill bit off-center to form a substantially straight borehole segment. The method may also (Continued)

include positioning the depth-of-cut controlling feature of the drill bit into contact with the formation to control the depth-of-cut and rotating the drill bit on-center to form a substantially nonlinear borehole segment.

20 Claims, 4 Drawing Sheets

Related U.S. Application Data

(60) Provisional application No. 61/248,777, filed on Oct. 5, 2009.

(51) Int. Cl.

| | |
|---|---|
| ***E21B 10/62*** | (2006.01) |
| ***E21B 7/04*** | (2006.01) |
| *E21B 10/54* | (2006.01) |

(56) References Cited

U.S. PATENT DOCUMENTS

| | | | |
|---|---|---|---|
| 2,198,849 | A | 4/1940 | Waxler |
| 2,563,515 | A | 8/1951 | Brown |
| 2,624,549 | A | 1/1953 | Wallace |
| 2,684,835 | A | 7/1954 | Moore |
| 2,776,817 | A | 1/1957 | Gregory et al. |
| 3,058,535 | A | 10/1962 | Williams, Jr. |
| 3,153,458 | A | 10/1964 | Short |
| 3,303,894 | A | 2/1967 | Varney |
| 3,308,896 | A | 3/1967 | Henderson |
| 3,536,150 | A | 10/1970 | Stebley |
| 3,709,308 | A | 1/1973 | Rowley et al. |
| 3,779,323 | A | 12/1973 | Horten et al. |
| 3,915,246 | A | 10/1975 | Sheshtawy et al. |
| 3,938,599 | A | 2/1976 | Horn |
| 4,006,788 | A | 2/1977 | Gamer |
| 4,116,289 | A | 9/1978 | Feenstra |
| 4,176,723 | A | 12/1979 | Arceneaux |
| 4,253,533 | A | 3/1981 | Baker |
| 4,351,401 | A | 9/1982 | Fielder |
| 4,386,669 | A | 6/1983 | Evans |
| 4,499,958 | A | 2/1985 | Radtke et al. |
| 4,512,426 | A | 4/1985 | Bidegaray |
| 4,554,986 | A | 11/1985 | Jones |
| 4,593,777 | A | 6/1986 | Barr |
| 4,718,505 | A | 1/1988 | Fuller |
| 4,763,737 | A | 8/1988 | Hellnick |
| 4,815,342 | A | 3/1989 | Brett et al. |
| 4,889,017 | A | 12/1989 | Fuller et al. |
| 4,932,484 | A | 6/1990 | Warren et al. |
| 4,942,933 | A | 7/1990 | Barr et al. |
| 4,981,184 | A | 1/1991 | Knowlton et al. |
| 4,982,802 | A | 1/1991 | Warren et al. |
| 4,991,670 | A | 2/1991 | Fuller et al. |
| 5,010,789 | A | 4/1991 | Brett et al. |
| 5,033,560 | A | 7/1991 | Sawyer et al. |
| 5,042,596 | A | 8/1991 | Brett et al. |
| 5,090,492 | A | 2/1992 | Keith |
| 5,111,892 | A | 5/1992 | Sinor |
| 5,131,478 | A | 7/1992 | Brett et al. |
| 5,199,511 | A | 4/1993 | Tibbitts et al. |
| 5,222,566 | A | 6/1993 | Taylor |
| 5,244,039 | A | 9/1993 | Newton |
| 5,265,685 | A | 11/1993 | Keith et al. |
| 5,303,785 | A | 4/1994 | Duke |
| 5,314,033 | A | 5/1994 | Tibbitts |
| 5,388,649 | A | 2/1995 | Ilomaki |
| 5,402,856 | A | 4/1995 | Warren et al. |
| 5,433,280 | A | 7/1995 | Smith |
| 5,437,343 | A | 8/1995 | Cooley et al. |
| 5,447,208 | A | 9/1995 | Lund et al. |
| 5,505,273 | A | 4/1996 | Azar |
| 5,531,281 | A | 7/1996 | Murdock |
| 5,544,550 | A | 8/1996 | Smith |
| 5,549,171 | A | 8/1996 | Mensa et al. |
| 5,558,170 | A | 9/1996 | Thigpen et al. |
| 5,582,258 | A | 12/1996 | Tibbitts et al. |
| 5,595,252 | A | 1/1997 | O'Hanlon |
| 5,607,025 | A | 3/1997 | Mensa-Wilmot |
| 5,651,421 | A | 7/1997 | Newton et al. |
| 5,653,300 | A | 8/1997 | Lund et al. |
| 5,663,512 | A | 9/1997 | Schader et al. |
| 5,720,357 | A | 2/1998 | Fuller et al. |
| 5,730,234 | A | 3/1998 | Putot |
| 5,738,178 | A | 4/1998 | Williams et al. |
| 5,839,329 | A | 11/1998 | Smith et al. |
| 5,873,422 | A | 2/1999 | Hansen et al. |
| 5,937,958 | A | 8/1999 | Mensa-Wilmot et al. |
| 5,957,006 | A | 9/1999 | Smith |
| 5,979,576 | A | 11/1999 | Hansen et al. |
| 6,073,518 | A | 6/2000 | Chow et al. |
| 6,089,123 | A | 7/2000 | Chow et al. |
| 6,123,161 | A | 9/2000 | Taylor |
| 6,142,250 | A | 11/2000 | Griffin et al. |
| 6,200,514 | B1 | 3/2001 | Meister |
| 6,209,420 | B1 | 4/2001 | Butcher et al. |
| 6,246,974 | B1 | 6/2001 | Jelley et al. |
| 6,298,930 | B1 | 10/2001 | Sinor et al. |
| 6,321,862 | B1 | 11/2001 | Beuershausen et al. |
| 6,408,958 | B1 | 6/2002 | Isbell et al. |
| 6,427,792 | B1 | 8/2002 | Roberts et al. |
| 6,450,271 | B1 | 9/2002 | Tibbitts et al. |
| 6,460,631 | B2 | 10/2002 | Dykstra et al. |
| 6,568,492 | B2 | 5/2003 | Thigpen et al. |
| 6,575,256 | B1 | 6/2003 | Doster |
| 6,581,671 | B2 | 6/2003 | Butcher et al. |
| 6,659,199 | B2 | 12/2003 | Swadi |
| 6,779,613 | B2 | 8/2004 | Dykstra et al. |
| 6,823,952 | B1 | 11/2004 | Mensa-Wilmot et al. |
| 6,834,733 | B1 | 12/2004 | Maouche et al. |
| 6,883,623 | B2 | 4/2005 | McCormick et al. |
| 6,892,828 | B2 | 5/2005 | Rives |
| 6,904,983 | B2 | 6/2005 | Thigpen et al. |
| 6,935,441 | B2 | 8/2005 | Dykstra et al. |
| 7,237,628 | B2 | 7/2007 | Desai et al. |
| 7,360,608 | B2 | 4/2008 | Brackin et al. |
| 7,395,882 | B2 | 7/2008 | Oldham et al. |
| 7,413,032 | B2 | 8/2008 | Krueger |
| 7,814,997 | B2 | 10/2010 | Aliko et al. |
| 8,127,863 | B2 | 3/2012 | Durairajan et al. |
| 8,141,665 | B2 | 3/2012 | Ganz |
| 8,448,726 | B2 | 5/2013 | Ganz |
| 2001/0030063 | A1 | 10/2001 | Dykstra et al. |
| 2001/0030065 | A1 | 10/2001 | Beuershausen et al. |
| 2002/0121393 | A1 | 9/2002 | Thigpen et al. |
| 2003/0029642 | A1 | 2/2003 | Dykstra et al. |
| 2004/0244540 | A1 | 12/2004 | Oldham et al. |
| 2004/0245022 | A1 | 12/2004 | Izaguirre et al. |
| 2004/0245024 | A1 | 12/2004 | Kernbaiyan |
| 2005/0211475 | A1 | 9/2005 | Mirchandani et al. |
| 2005/0230150 | A1 | 10/2005 | Oldham et al. |
| 2007/0017710 | A1 | 1/2007 | Achilles et al. |
| 2007/0144789 | A1* | 6/2007 | Johnson ..... E21B 10/43 175/431 |
| 2007/0151770 | A1 | 7/2007 | Ganz |
| 2007/0289782 | A1 | 12/2007 | Clark et al. |
| 2008/0308321 | A1 | 12/2008 | Aliko et al. |
| 2009/0145663 | A1 | 6/2009 | Durairajan et al. |
| 2009/0145669 | A1 | 6/2009 | Durairajan et al. |
| 2010/0276200 | A1 | 4/2010 | Schwefe et al. |
| 2010/0270077 | A1 | 10/2010 | Huynh et al. |
| 2011/0079438 | A1 | 4/2011 | Schwefe et al. |
| 2012/0168231 | A1 | 7/2012 | Ganz |
| 2012/0186879 | A1 | 7/2012 | Durairajan et al. |

FOREIGN PATENT DOCUMENTS

| | | | |
|---|---|---|---|
| EP | 822318 | B1 | 6/2002 |
| EP | 1236861 | A1 | 9/2002 |
| EP | 874128 | A2 | 12/2004 |
| GB | 2190120 | A | 11/1987 |
| GB | 2273946 | A | 7/1994 |
| GB | 2326659 | A | 12/1998 |

(56) References Cited

FOREIGN PATENT DOCUMENTS

| | | | |
|---|---|---|---|
| GB | 2329203 | A | 3/1999 |
| GB | 2370592 | A | 7/2002 |
| WO | 2007070648 | A2 | 6/2007 |

OTHER PUBLICATIONS

DOCC bit—surface test Memorandum from Wayne Hansen dated May 11, 1998 2 pages Proprietary Material Subject to Protective Order—Document Filed Separately by Express Mail on Aug. 21, 2008 Pursuant to M.P.E.P. Section 724 With Petition Under 37 CFR Section 1.59.
1995 Hughes Christensen Drill Bit Catalog p. 31.
Christensen Diamond Compact Bit Manual 1982 89 pages.
Counterclaim-Defendants' Amended Invalidity Contentions Pursuant to Patent Rule 3-3 signed by James A. Jorgensen Feb. 8, 2008 Filed in Civil Action No. 6:06-CV-222 (LED) in the United Stated District Court for the Eastern District of Texas Tyler Division 19 pages (nonmaterial portions redacted).
Drill Bit Developments the Institution of Mechanical Engineers Offshore Engineering Group seminar held Apr. 26, 1989 in Aberdeen Scotland.
Fabian Robert T. Confined compressive strength analysis can improve PDC bit selection Oil & Gas Journal May 16, 1994 5 pages.
Hansen Wayne Depth of Cut Control Feature Phase I 81/2" G554A2 May 1998 35 pages Proprietary Material Subject to Protective Order—Document Filed Separately by Express Mail on Aug. 21, 2008 Pursuant to M.P.E.P. Section 724 With Petition Under 37 CFR Section 1.59.
Hughes Christensen Bit Drawing dated Sep. 18, 1996—HC Part No. CW 210655.
Hughes Christensen Bit Drawing dated Sep. 18, 1996—HC Part No. CS205023.
Hughes Christensen Bit Drawing dated May 29, 1997—HC Part No. CC201918.
Hughes Christensen Bit Drawing dated Sep. 9, 1996—HC Part No. CC201718.
International PCT International Search Report for PCT/US2006/047778 dated Jun. 4, 2007.
International Preliminary Report on Patentability for International Application No. PCT/US2010/051504 dated Apr. 11, 2012 4 pages.
International Search Report for International Application No. PCT/US2010/051504 dated May 13, 2011 3 pages.
International Search Report for International Application No. PCT/US2008/066947 dated Mar. 11 2008 4 pages.
International Search Report for International Application No. PCT/US2010/032370 dated Jan. 3, 2011 3 pages.
International Written Opinion for International Application No. PCT/US2010/051504 dated May 13, 2011 3 pages.
International Written Opinion for International Application No. PCT/US2010/032370 dated Jan. 3, 2011 3 pages.
Maurer William C. Advanced Drilling Techniques 1980 pp. 541 and 568 The Petroleum Publishing Company Tulsa Oklahoma.
Nussbaum Mark E. Expert Report dated Jan. 7, 2008 Filed in Civil Action No. 6:06-CV-222 (LED) in the United Stated District Court for the Eastern District of Texas Tyler Division 57 pages (nonmaterial portions redacted).
Order Re Stipulated Motion for Dismissal With Prejudice United States District Court for the Easter District of Texas Tyler Division Civil Action No. 6:06-CV-222 (LED) dated Jun. 26, 2008.
Plaintiffs' First Amended Reply to Baker Hughes Oilfield Operations Inc.'s and Baker Hughes Inc.'s First Amended Answer and Counterclaims and Plaintiffs' Counterclaims for Declaratory Judgment of Patent Invalidity Non-Infringement and Unenforceability Signed by J. Mike Amerson dated Feb. 23, 2007 filed in Civil Action No. 6:06-CV-222 (LED) in the United Stated District Court for the Eastern District of Texas Tyler Division 11 pages (nonmaterial portions redacted).
Search Report of the Belgian Patent Office dated Aug. 14 2001 for Application No. BE20000528.
Search Report of the UK Patent Office dated Dec. 7, 2000 for Application No. GB0020134.3.
Smith Diamond Drill Bit brochure bit type M-21 IADC M646 2 pages circa 1990's.
Spaar J.R. et al. Formation Compressive Strength Estimates for Predicting Drillability and PDC Bit Selection SPE/IADC 29397 presented at the SPE/IADC Drilling Conference held in Amsterdam Feb. 29-Mar. 2, 1995.
Stipulated Motion for Dismissal With Prejudice United States District Court for the Easter District of Texas Tyler Division Civil Action No. 6:06-cv-222 (LED) dated Jun. 25, 2008.
Taylor M.R. et al. High Penetration Rates and Extended Bit Life Through Revolutionary Hydraulic and Mechanical Design in PDC Drill Bit Development SPE 36435 presented at the SPE Annual Technical Conference and Exhibition held in Denver Colorado Oct. 6-9, 1996 14 pages.
U.S. Appl. No. 13/894,802, filed May 15, 2013 19 pages.
Williams J.L. et al. An Analysis of the Performance of PDC Hybrid Drill Bits SPE/IADC 16117 presented at the SPE/IADC Drilling Conference held in New Orleans LA on Mar. 15-18, 1987.

* cited by examiner

DRILL BITS AND TOOLS FOR SUBTERRANEAN DRILLING INCLUDING RUBBING ZONES AND RELATED METHODS

CROSS-REFERENCE TO RELATED APPLICATIONS

This application is a continuation of U.S. patent application Ser. No. 12/898,451, filed Oct. 5, 2010, now U.S. Pat. No. 9,309,723, issued Apr. 12, 2016, which claims the benefit of U.S. Provisional Patent Application Ser. No. 61/248,777, filed Oct. 5, 2009, titled "DRILL BITS AND TOOLS FOR SUBTERRANEAN DRILLING, METHODS OF MANUFACTURING SUCH DRILL BITS AND TOOLS AND METHODS OF DIRECTIONAL AND OFF-CENTER DRILLING," the disclosure of each of which is hereby incorporated herein in its entirety by this reference.

TECHNICAL FIELD

Embodiments of the invention relate to drill bits and tools for subterranean drilling and, more particularly, embodiments relate to drill bits incorporating structures for enhancing contact and rubbing area control and improved directional and off-center drilling.

BACKGROUND

Boreholes are formed in subterranean formations for various purposes including, for example, extraction of oil and gas from subterranean formations and extraction of geothermal heat from subterranean formations. Boreholes may be formed in subterranean formations using earth-boring tools such as, for example, drill bits.

To drill a borehole with a drill bit, the drill bit is rotated and advanced into the subterranean formation under an applied axial force, commonly known as "weight on bit," or WOB. As the drill bit rotates, the cutters or abrasive structures thereof cut, crush, shear, and/or abrade away the formation material to form the borehole, depending on the type of bit and the formation to be drilled. A diameter of the borehole drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the borehole from the surface of the formation. Often various subs and other components, such as a downhole motor, a steering sub or other assembly, a measuring while drilling (MWD) assembly, one or more stabilizers, or a combination of some or all of the foregoing, as well as the drill bit, may be coupled together at the distal end of the drill string at the bottom of the borehole being drilled. This assembly of components is referred to in the art as a "bottom hole assembly" (BHA).

The drill bit may be rotated within the borehole by rotating the drill string from the surface of the formation, or the drill bit may be rotated by coupling the drill bit to a down-hole motor, which is also coupled to the drill string and disposed proximate to the bottom of the borehole. The downhole motor may comprise, for example, a hydraulic Moineau-type motor having a shaft, to which the drill bit is mounted, that may be caused to rotate by pumping fluid (e.g., drilling fluid or "mud") from the surface of the formation down through the center of the drill string, through the hydraulic motor, out from nozzles in the drill bit, and back up to the surface of the formation through an annulus between the outer surface of the drill string and the exposed surface of the formation within the borehole. As noted above, when a borehole is being drilled in a formation, axial force or "weight" is applied to the drill bit (and reamer device, if used) to cause the drill bit to advance into the formation as the drill bit drills the borehole therein.

It is known in the art to employ what are referred to as "depth-of-cut control" (DOCC) features on earth-boring drill bits which are configured as fixed-cutter, or so-called "drag" bits, wherein polycrystalline diamond compact (PDC) cutting elements, or cutters, are used to shear formation material. For example, U.S. Pat. No. 6,298,930 to Sinor et al., issued Oct. 9, 2001, discloses rotary drag bits that including exterior features to control the depth of cut by PDC cutters mounted thereon, so as to control the volume of formation material cut per bit rotation as well as the reactive torque experienced by the bit and an associated bottom-hole assembly. The exterior features may provide sufficient bearing area so as to support the drill bit against the bottom of the borehole under weight-on-bit without exceeding the compressive strength of the formation rock. However, such depth-of-cut control features may not be well suited for drilling all borehole segments during directional drilling applications. For example, when drilling in slide mode (i.e., on-center drilling and directional drilling) to form a non-linear borehole segment, it may be desirable to maintain a relatively small depth of cut to improve steerability; however, conventional depth-of-cut control features may hinder efficient drilling in rotate mode (i.e., off-center drilling and vertical drilling) wherein a higher rate of penetration (ROP) is desirable.

In view of the foregoing, improved drill bits for directional drilling applications, improved methods of manufacturing such bits and improved methods of directional and off-center drilling applications would be desirable.

BRIEF SUMMARY

In some embodiments, a drill bit for subterranean drilling may have a cutter profile comprising a concavity radially extending greater than a width of any single cutter defining the cutter profile.

In further embodiments, a drill bit for subterranean drilling may include a bit body including a plurality of blades, and at least one blade of the plurality of blades may extend at least partially over a cone region of the bit body. Additionally, the drill bit may include a plurality of cutting structures mounted to the at least one blade extending at least partially over the cone region, and the drill bit may include a rubbing zone within the cone region of the at least one blade, wherein cutting structures have a reduced average exposure.

In additional embodiments, a method of directional drilling may include positioning a depth-of-cut controlling feature of a drill bit to prevent more than incidental contact between the depth-of-cut controlling feature and the formation being drilled while rotating the drill bit off-center to form a substantially straight borehole segment. The method may also include positioning the depth-of-cut controlling feature of the drill bit for effective rubbing contact with the formation to control the depth-of-cut while rotating the drill bit on-center to form a nonlinear, such as a substantially arcuate, borehole segment.

DETAILED DESCRIPTION

Illustrations presented herein are not meant to be actual views of any particular drill bit or other earth-boring tool, but are merely idealized representations which are employed to describe the present invention. Additionally, elements common between figures may retain the same numerical designation.

The various drawings depict embodiments of the invention as will be understood by the use of ordinary skill in the art and are not necessarily drawn to scale.

Figure 1:
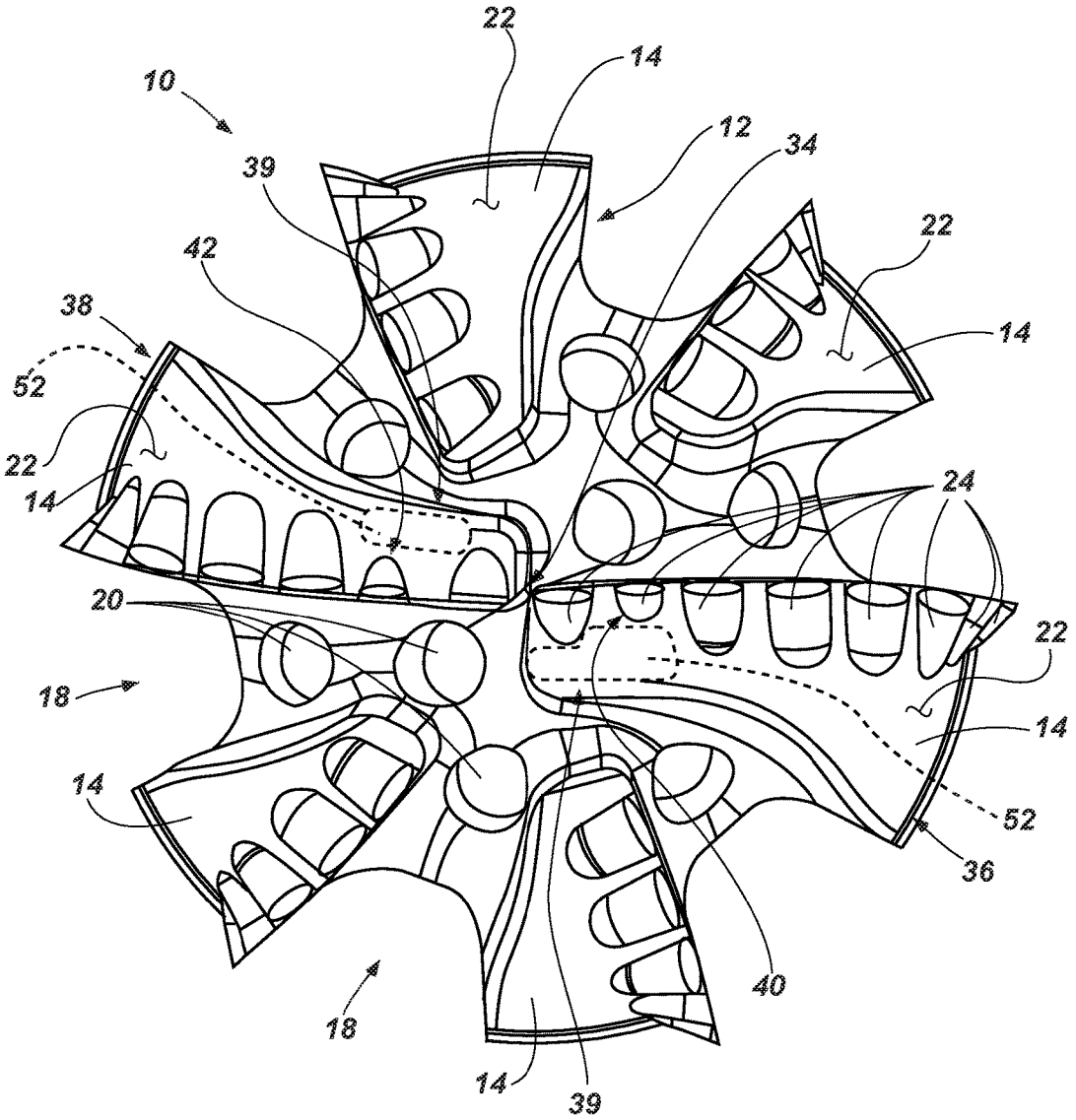
FIG. 1 shows the face of a drill bit according to an embodiment of the present invention.

In some embodiments, as shown in FIG. 1, a drill bit 10 may have a bit body 12 that includes a plurality of blades 14 thereon. Each blade 14 may be separated by fluid courses 18, which may include fluid nozzles 20 positioned therein. Each blade 14 may include a blade face 22 with cutting structures mounted thereto. For example, each blade 14 may include a plurality of PDC cutters 24 positioned within cutter pockets formed in the blade 14 along a rotationally leading edge thereof. A portion of each cutter 24 may extend out of its respective cutter pocket beyond the blade face 22. The extent to which each cutter 24 extends beyond the blade face 22 defines the exposure of each cutter 24. For example, one or more cutters 24 may be mounted relatively deeper within a pocket, such that the cutter 24 exhibits a reduced exposure. As another example, one or more cutters 24 may be mounted relatively shallower within a cutter pocket, such that the cutter 24 exhibits an increased exposure. As a practical matter, such relatively deeper or shallower exposure may be achieved by forming the cutter pockets to hold the cutters 24 at desired depths to achieve desired exposures in the blade leading end face during manufacture of the drill bit 10.

Figure 2:
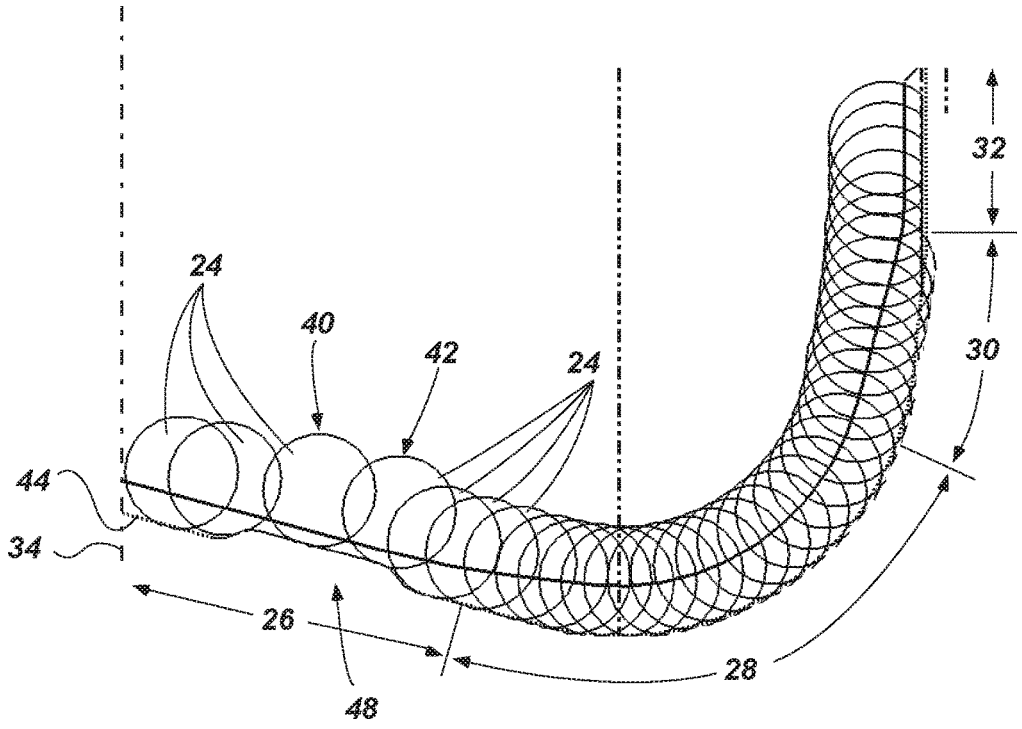
FIG. 2 shows a cutter profile of the drill bit of FIG. 1, having a concavity in a cone region.

The blades 14 and cutters 24 may define a face of the bit 10 that may include a cone region 26, a nose region 28, a shoulder region 30 and a gage region 32 (FIG. 2). The cone region 26 may be generally shaped as an inverted cone and is generally located at a central axis 34 of the drill bit 10 and centrally located on the face of the drill bit 10. At least one blade 36, 38 may extend at least partially over the cone region 26 of the face of the drill bit 10 and include a rubbing zone 39, which may be utilized as a depth-of-cut controlling feature, in the cone region 26 of the blade 36, 38 wherein cutters 40, 42 within the rubbing zone 39 have a reduced average exposure.

Figure 3:
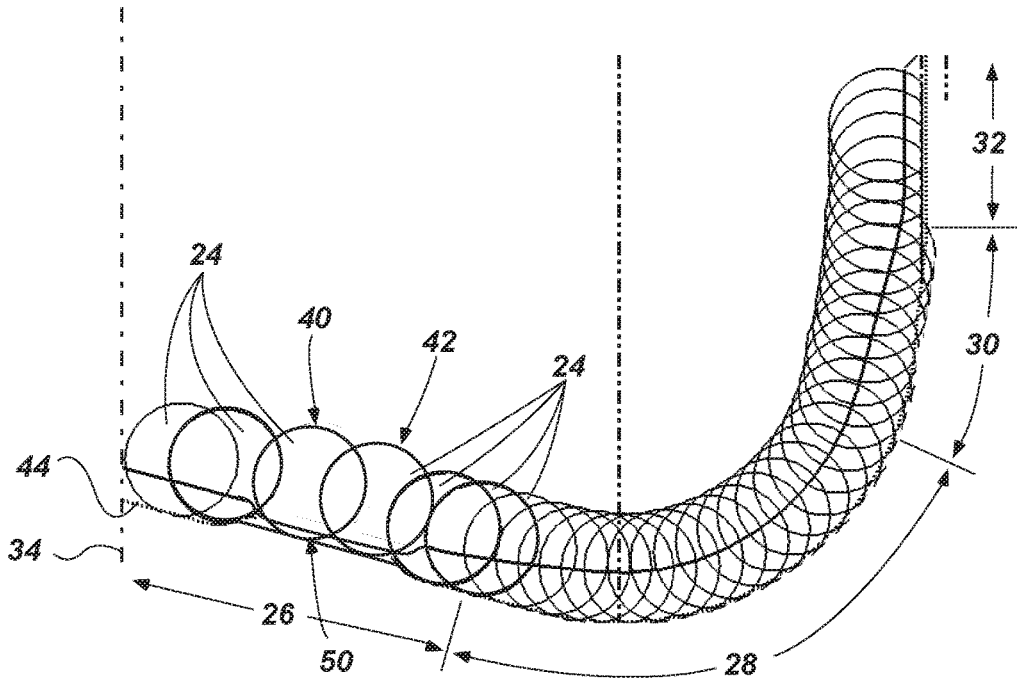
FIG. 3 shows a cutter profile of another bit, having a blade protrusion in a cone region, according to another embodiment of the present invention.

In some embodiments, such as shown in FIG. 2, a cutter profile 44 defined by the plurality of cutters 24 includes a concavity 48 within the rubbing zone 39, which may, in combination with the use of more deeply inset cutters 24 of the same diameter as shown, result in a reduced average exposure of the cutters 40, 42 within the rubbing zone 39. In additional embodiments, such as shown in FIG. 3, one or more blades 36, 38 may include a protrusion 50 within the rubbing zone 39, which may also, in combination with cutters 40, 42 set at a reduced average height when compared to flanking cutters 24, result in a reduced average exposure of the cutters 40, 42 within the rubbing zone 39. In further embodiments, one or more blades 36, 38 may include a protrusion 50 within the rubbing zone 39, which may also, in combination with cutters 40, 42 set to the same depth as radially flanking cutters 24 of the same diameter, result in a reduced average exposure of the cutters 40, 42 within the rubbing zone 39. In yet additional embodiments, one or more blades 36, 38 may include an optional rubbing insert 52 positioned within the rubbing zone 39, as indicated in FIG. 1.

FIG. 2 illustrates what is known in the art as a cutter profile 44 of the drill bit 10, and shows a cross-section of the blade 36. Each of the overlapping circles shown in FIG. 2 represents the position that would be occupied on the blade 36 by the cutting face of a cutter 24 if each of the cutters 24 were rotated circumferentially about the central longitudinal axis 34 of the drill bit 10 to a position on the blade 36. As seen in FIG. 2, cutting edges of the cutters 24 may define a cutter profile 44, which is approximately represented. In such embodiments, where the cutter profile 44 has a concavity 48 within the cone region 26, as shown in FIG. 2, the rubbing zone 39 may be located on the blade 36 rotationally following the cutters 40, 42 having a reduced exposure and forming the concavity 48 of the cutter profile 44. As shown, the concavity 48 may be defined by more than one cutter 24, for example the concavity 48 may be defined by two cutters 40, 42, and may radially extend, relative to the central longitudinal axis 34 of the drill bit 10, greater than the width of any single cutter 24 defining the cutter profile 44. While the cutter profile 44 may exhibit a concavity 48, the blade surface 22 of the blade 36 may not exhibit a concavity, and the cutters 40, 42 defining the concavity 48 in the cutter profile 44 may have a reduced average exposure relative to other cutters 24 within the cone region 26 of the bit face and may have a reduced average exposure relative to cutters in the nose region 28 and the shoulder region 30. In such an embodiment, the rubbing zone 39 may extend over regions of the cutter faces 22 that rotationally trail the concavity 48 in the cutter profile 44 and the regions of the cutter faces 22 within the rubbing zone 39 may provide a depth-of-cut controlling feature.

In additional embodiments, as shown in FIG. 3, the cutter profile 44 of a drill bit 10 may not include a concavity 48 and one or more blades 36, 38 may include a protrusion 50 in the cone region 26. As one or more blades 36, 38 may include a protrusion 50, and the cutter profile 44 may not exhibit a protrusion, the cutters 40, 42 rotationally preceding the protrusion 50 may have a reduced average exposure relative to other cutters 24 within the cone region 26 of the bit body 10 and may have a reduced average exposure relative to cutters 24 in the nose region 28 and the shoulder region 30. In such an embodiment, the rubbing zone 39 may extend over the protrusions 50 of the cutter faces 22 of the blades 36, 38 and the protrusions 50 of the cutter faces 22 may provide a depth-of-cut controlling feature.

In some embodiments, the drill bit 10 may include one or more rubbing inserts 52, as shown in FIG. 1, which may be located within the rubbing zone 39 within the cone region 26 of the drill bit 10. The rubbing inserts 52 may comprise an abrasion resistant material and may be positioned on and coupled to one or more blades 36, 38. For example, the rubbing inserts 52 may be formed of tungsten carbide and may be brazed into pockets formed in the blade faces 22 of the blades 36, 38. In some embodiments, the rubbing inserts 52 may be configured and positioned within the blades 36, 38 to protrude from the blade faces 22 and may define protrusions, such as protrusion 50 (FIG. 3), from the blade faces 22. In additional embodiments, the rubbing inserts 52 may be configured and positioned within the blades 36, 38 and a surface of the rubbing inserts 52 may substantially align with the blade faces 22 and may be positioned within a rubbing zone 39 rotationally trailing a concavity 48 in the cutter profile 44, each rubbing insert 52 positioned rotationally trailing a cutting insert 40, 42 having a reduced exposure, such as shown in FIGS. 1 and 2. Rubbing inserts 52 may provide several advantages, for example, rubbing inserts 52 may extend the useful life of the drill bit 10 and prevent excessive wearing of the blade faces 22. For another example, the rubbing inserts 52 may be removed and replaced, to extend the useful life of the drill bit 10 and to provide a more flexible design for the drill bit 10, as the height of the rubbing insert 52 may be changed, and thus the rubbing contact of the rubbing insert 52 may be changed as desired and the exposure of the rotationally preceding cutters 24 may also be changed. In embodiments having rubbing inserts 52, the rubbing zone 39 may extend over the rubbing inserts 52 and the rubbing inserts 52 may provide a depth-of-cut controlling feature.

Figure 4:
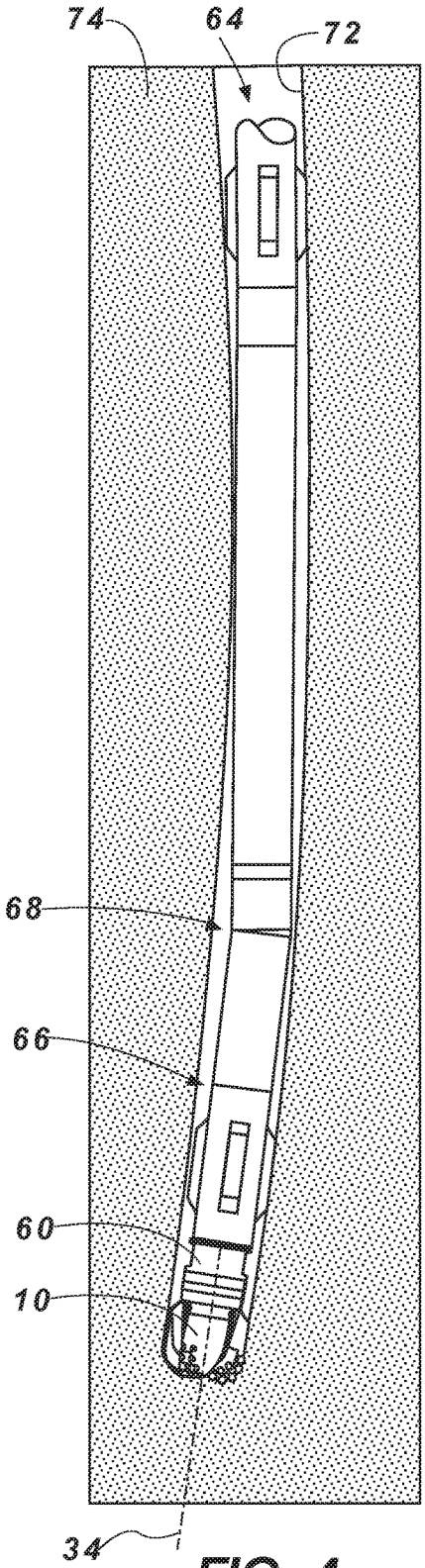
FIG. 4 shows a drill bit according to an embodiment of the present invention attached to a drill string in operated in slide mode.
Figure 5:
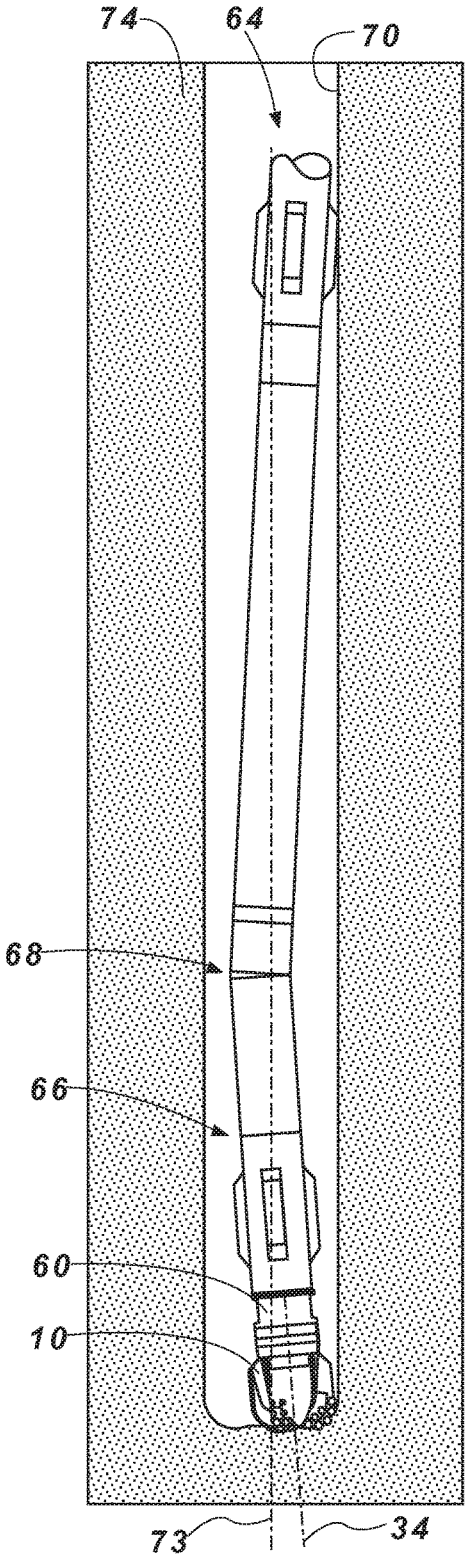
FIG. 5 shows the drill bit and drill string of FIG. 4 operated in rotate mode.

As shown in FIGS. 4 and 5, the drill bit 10 may also include a shank 60 attached to a bit body 62 and the shank 60 may be attached to a drill string 64. For directional drilling applications, as shown in FIGS. 3 and 4, the drill bit 10 may be coupled to a downhole motor 66, which may be positioned beneath a bent sub 68. The drill string 64 may be coupled to a drilling rig (not shown) located at the top of the borehole 70, 72 which may rotate the drill string 64 and may direct fluid (i.e., drilling mud) through the drill string 64. In view of this, the entire drill string 64 may be rotated (i.e., rotate mode) and the drill bit 10 may be rotated along an axis of rotation 73 that is different than the central longitudinal axis 34 of the drill bit 10, or "off-center," and may form a substantially straight borehole segment 70, as shown in FIG. 5. Alternatively, the bent sub 68 and the drill string 64 above the bent sub 68 may not be rotated and the drill bit 10 may be rotated by the downhole motor 66 alone, substantially along its central longitudinal axis 34, or "on-center," below the bent sub 68. As the drill bit 10 is rotated on-center, the drill bit 10 may drill a generally arcuate or other nonlinear borehole segment 72 (i.e., slide mode), as shown in FIG. 4, in a direction generally following that of the bend in the bent sub 68.

In slide mode operations, as shown in FIG. 4, a depth-of-cut controlling feature within the rubbing zone 39 in the cone region of the drill bit 10 may be positioned into effective rubbing contact with a formation 74. As used herein, the term "effective rubbing contact" means contact, which may be substantially constant or may be intermittent, that is effective to limit a depth-of-cut of cutters proximate to the rubbing zone while drilling. As the bit is rotated, the depth-of-cut controlling feature, such as the region of the blades 36, 38 rotationally trailing the cutters 40, 42 having the reduced average exposure, may effectively rub against the formation 74 and may inhibit excessive penetration of the cutting structures 24 cutting into the formation 74. In other words, as the weight on bit increases, the rate of penetration of the drill bit 10 may be controlled and remain substantially the same or be predictably and controllably increased, when compared to a drill bit 10 without a depth-of-cut controlling feature. By controlling the depth-of-cut, more specifically by providing a substantially consistent depth-of-cut, a more consistent and accurate nonlinear borehole segment 72 may be formed during a slide mode operation and the path of the borehole segment 72 may be more accurately predicted and controlled.

Figure 7:
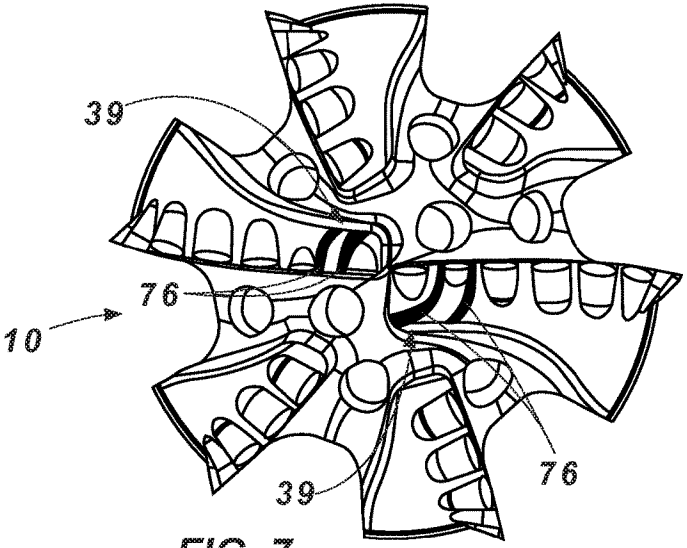
FIG. 7 shows a predicted rubbing area superimposed on the face of the drill bit of FIG. 1 at a depth-of-cut of about 0.1 inch per revolution in slide mode.
Figure 8:
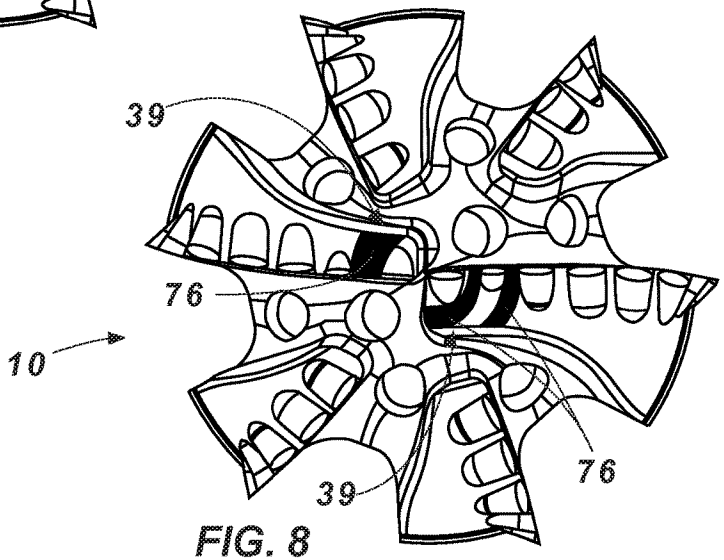
FIG. 8 shows a predicted rubbing area superimposed on the face of the drill bit of FIG. 1 at a depth-of-cut of about 0.2 inch per revolution in slide mode.
Figure 6:
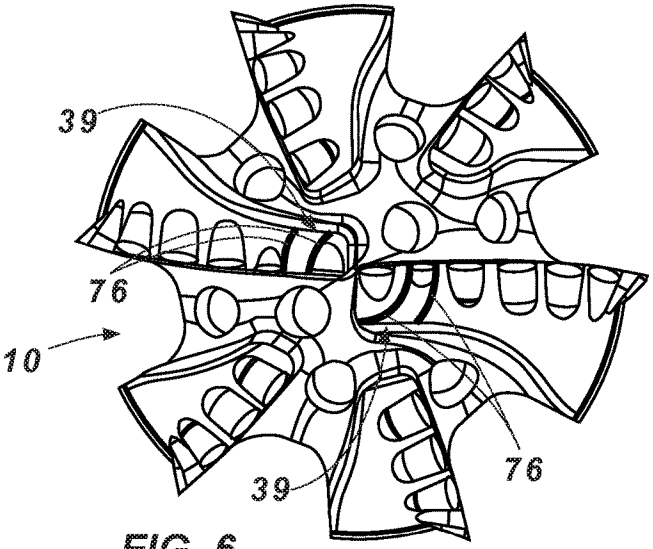
FIG. 6 shows a predicted rubbing area superimposed on the face of the drill bit of FIG. 1 at a depth-of-cut of about zero inches per revolution in slide mode.

FIGS. 6, 7 and 8 show the predicted rubbing area 76 for the drill bit 10 shown in FIGS. 1 and 2 at different depths-of-cut during slide mode operation. FIG. 6 shows a predicted rubbing area 76 for a depth-of-cut of about zero (0) inches per revolution; as shown, it is predicted that about 10% of the rubbing zone 39 will contact the formation 74 (FIGS. 4 and 5). FIG. 7 shows a predicted rubbing area 76 for a depth-of-cut of about 0.1 inch per revolution; as shown, it is predicted that about 25% of the rubbing zone 39 will contact the formation 74 (FIGS. 4 and 5). FIG. 8 shows a predicted rubbing area 76 for a depth-of-cut of about 0.2 inch per revolution; as shown, it is predicted that about 50% of the rubbing zone 39 will contact the formation 74 (FIGS. 4 and 5). As shown in FIGS. 6, 7 and 8, the rubbing between the formation 74 (FIGS. 4 and 5) and the drill bit 10 during slide mode operation may be substantially limited to the rubbing zone 39 and the depth-of-cut control feature within the cone region 26 (FIGS. 2 and 3) of the drill bit 10. These rubbing area percentages are provided as non-limiting examples. Rubbing area percentages will vary based on several bit design factors, including: the size of the bit, the number of blades the rubbing zone is applied to, the cutter density, and the geometry of the concavity.

In rotate mode operations, as shown in FIG. 5, it may not be desirable to utilize the depth-of-cut controlling feature. When the drill bit 10 is rotated off-center to form a substantially straight borehole segment 70 is formed it may be more efficient to have an increased depth-of-cut and a reduced rubbing, as a reliable substantially straight borehole segment 70 may be maintained at a higher depth-of-cut and reduced rubbing may result in a more efficient drilling of the substantially straight borehole segment 70. As the rubbing zone 39 and depth-of-cut control feature may be positioned within the cone region 26 of the drill bit 10, the depth-of-cut controlling feature may be located away from the formation 74 by slight cavitation of the drill bit 10 due to the presence of the bent sub 68, which may prevent more than incidental contact between the depth-of-cut controlling feature and the formation 74 during rotate mode operations, as shown in FIG. 5, resulting in a deeper depth of cut and higher ROP. Any incidental contact may be intermittent and may not result in substantial forces between the formation 74 and the depth-of-cut controlling feature, unlike rubbing contact.

In additional embodiments, a cone angle, which may be defined by an angle between the blade face 22 in the cone region 26 and the central longitudinal axis 34 of the drill bit 10, may also be adjusted in combination with providing a depth-of-cut control feature in the cone region 26 to provide the desired removal of contact of the depth-of-cut control feature with the formation during substantially straight drilling with a directional drilling BHA. For example, a cone angle may be chosen, in combination with the placement and of the depth-of-cut control feature, which effectively enables the depth-of-cut feature within the cone region 26 to be removed from contact with the formation 74 during off-center drilling operations (i.e., rotate mode operations) for drilling a substantially straight borehole segment.

In view of the foregoing, drill bits 10 as described herein may be utilized to reduce detrimental rubbing during off-center drilling operations, such as shown in FIG. 5, while providing desirable depth-of-cut control during on-center drilling operations.

Although this invention has been described with reference to particular embodiments, the invention is not limited to these described embodiments. Rather, the invention is limited only by the appended claims, which include within their scope all equivalent devices and methods according to principles of the invention as described.

What is claimed is:

1. A drill bit for subterranean drilling, comprising:

a bit body including at least one blade;

a plurality of cutting structures mounted to the at least one blade;

a rubbing zone on a surface of the at least one blade; and a protrusion protruding from a surface of the at least one blade within the rubbing zone, the protrusion separate and distinct from the plurality of cutting structures and radially extending greater than a width of at least two cutting structures of the plurality of cutting structures.

2. The drill bit of claim 1, wherein the rubbing zone rotationally trails at least some of the cutting structures located in a cone region of the drill bit.

3. The drill bit of claim 2, wherein at least some of the cutting structures located within the rubbing zone exhibit a reduced average exposure relative to average exposures of other cutting structures within the cone region of the drill bit.

4. The drill bit of claim 1, wherein the protrusion comprises at least one rubbing insert positioned within the rubbing zone, the at least one rubbing insert comprising tungsten carbide, the at least one rubbing insert brazed into at least one pocket in the surface of the at least one blade.

5. The drill bit of claim 1, wherein the plurality of cutting structures defines a cutter profile extending from a gage region of the at least one blade to a center axis of the drill bit.

6. The drill bit of claim 5, wherein the cutter profile comprises a concavity within the rubbing zone, the concavity extending greater than a width of any single cutting structure defining the cutter profile.

7. The drill bit of claim 1, wherein the rubbing zone is configured to provide depth-of-cut control when the drill bit is rotated on-center and is configured to not rub on a formation when the drill bit is rotated off-center in the formation.

8. An earth-boring tool, comprising:

a bit body including at least one blade;

cutting structures mounted on the at least one blade; and a protrusion region protruding from a surface of the at least one blade, the protrusion region having a length extending radially along the at least one blade, wherein the length of the protrusion region is greater than a width of at least two cutting structures.

9. The earth-boring tool of claim 8, wherein the protrusion region is located in a cone region of the bit body.

10. The earth-boring tool of claim 9, wherein at least one of the cutting structures is located in the cone region and has an exposure less than at least one other cutting structure that is located in a nose region of the bit body.

11. The earth-boring tool of claim 8, wherein the protrusion region is integral with the at least one blade or distinct from and coupled to the at least one blade.

12. The earth-boring tool of claim 8, wherein the protrusion region is:

positioned to inhibit more than incidental contact between the protrusion region and a formation during off-center drilling of a substantially linear borehole segment; and positioned into effective rubbing contact with the formation to control depth-of-cut of the cutting structures during on-center drilling of a non-linear borehole segment.

13. The earth-boring tool of claim 8, wherein the protrusion region comprises a rubbing surface comprising at least one rubbing area configured to contact a formation during at least on-center drilling, the rubbing surface comprising an abrasion resistant material.

14. The earth-boring tool of claim 13, wherein the rubbing surface comprises at least one rubbing insert, an upper surface of the at least one rubbing insert extended above the surface of the at least one blade.

15. The earth-boring tool of claim 13, wherein the rubbing surface is positioned to rotationally follow a concavity in a cutter profile, the cutter profile defined by the cutting structures.

16. The earth-boring tool of claim 15, wherein:

the concavity in the cutter profile has a length extending radially along the at least one blade, wherein the length of the concavity is greater than a width of a single cutting structure defining the cutter profile; and the cutting structures located within the concavity exhibit reduced average exposure relative to the cutting structures located outside the concavity.

17. A method of drilling a formation, comprising:

rotating a drill bit in contact with a formation to engage the formation with a plurality of cutting structures, at least some of the cutting structures located within a rubbing zone in a cone region of the drill bit, the rubbing zone having a protrusion protruding from a surface of the rubbing zone;

rotationally leading the rubbing zone with at least some of the cutting structures having a reduced level of exposure relative to cutting structures located outside the rubbing zone; and adjusting an angle between an axis of rotation and a central longitudinal axis of the drill bit to control effective rubbing contact of the rubbing zone with the engaged formation.

18. The method of claim 17, further comprising contacting the engaged formation with a depth-of-cut controlling feature located within the rubbing zone during directional drilling.

19. The method of claim 17, further comprising:

limiting an extent of contact of the rubbing zone to the engaged formation during off-center drilling; and limiting a maximum depth-of-cut of the plurality of cutting structures during on-center drilling by engaging the formation with a rubbing insert in the rubbing zone.

20. The method of claim 19, wherein limiting the maximum depth-of-cut of the plurality of cutting structures comprises limiting an extent of exposure of at least some of the cutting structures rotationally leading a protrusion in the rubbing zone.

* * * * *